US006152499A

United States Patent [19]

Robert

[11] Patent Number: 6,152,499

[45] Date of Patent: Nov. 28, 2000

[54] CASKET LOCK

[75] Inventor: Pascal Robert, Victoriaville, Canada

[73] Assignee: Cercuiels Vic Royal, Inc., Victoriaville, Canada

[21] Appl. No.: 09/286,399

[22] Filed: Apr. 5, 1999

Related U.S. Application Data

[63] Continuation-in-part of application No. 09/175,085, Oct. 19, 1998.

[51] Int. Cl.[7] ..... E05C 1/04

[52] U.S. Cl. ..... 292/153; 292/240; 292/304; 292/DIG. 11; 27/DIG. 1

[58] Field of Search ..... 292/153, 240, 292/241, 304, DIG. 11, DIG. 38, DIG. 64, DIG. 61; 70/38 A, 39, 37, 367; 27/DIG. 1

[56] References Cited

U.S. PATENT DOCUMENTS

| | | | |
|---|---|---|---|
| 2,417,756 | 3/1947 | Hillenbrand | 292/157 |
| 3,224,066 | 12/1965 | Overland | 292/240 |
| 4,195,503 | 4/1980 | Roberts | 70/366 |
| 4,987,753 | 1/1991 | Kuo | 70/39 |
| 5,060,993 | 10/1991 | Maier | 292/241 |
| 5,297,405 | 3/1994 | Manning et al. | 70/208 |
| 5,331,830 | 7/1994 | Su | 70/38 R |
| 5,457,861 | 10/1995 | Lloyd | 27/10 |
| 5,823,021 | 10/1998 | Chang | 70/38 A |
| 5,832,762 | 11/1998 | McDaid | 70/455 |

OTHER PUBLICATIONS

1995 Catalog of Richelieu products.
1995 Catalog of Hettich Canada L.P. products.
1997 Catalog of Häfele products.

*Primary Examiner*—Lynne H. Browne
*Assistant Examiner*—John B Walsh
*Attorney, Agent, or Firm*—St. Onge Steward Johnston & Reens LLC

[57] ABSTRACT

A lock of the catch type adapted to use in combination with a casket is disclosed. The lock includes a locking pin and a receiving element. The locking pin in installed on the lid of the casket and has a portion configured so to enable it to engage and remain engaged, when so desired, in the receiving element of the lock. The receiving element is installed in one of the side walls of the casket so that it is directly opposite to the locking pin. The receiving element comprises a hollow cylinder case adapted to be inserted and rotate with respect to a sleeve. The hollow cylinder case and the sleeve each comprises an opening for receiving the corresponding portion of the locking pin. The receiving element further including a compressible O-ring for enabling the hollow cylinder case to be inwardly biased against the sleeve during locking and unlocking of the lock.

19 Claims, 3 Drawing Sheets

CASKET LOCK

RELATED APPLICATIONS

This application is a continuation-in-part of application Ser. No. 09/175,085 of Oct. 19, 1998.

FIELD OF THE INVENTION

The present invention relates to improved locks adapted to be installed in caskets. More precisely, the present invention is concerned with a lock of the catch-type which is easy to use and easy to install on the casket.

DESCRIPTION OF PRIOR ART

It is well known to use locks in caskets for locking the lid of same. However, the locking means commonly used are often difficult to manipulate, as they provide no means to indicate whether or not the casket is locked. Furthermore, some of the locks are indiscreet in that they are quite noisy and require a special key to activate them.

In addition, because of the fact that some caskets are made of wood and that they constitute essentially of a five-sided open box, they may warp or be easily deformed. This in turn, may cause a misalignment of the lid with respect to the four walls of the casket which in turn may render locking of same difficult. As a result, it may be difficult to close the casket properly.

Ball catch locks such as those comprising a miter joint connector and a connecting bolt are commonly known and used. However they are not reliable locking means as the miter joint connector is not tightly fastened to the supporting member on which it is installed. As a result it easily falls out of place when the connecting bolt is released therefrom. Indeed, in most locks of the ball catch type such as previously described, the joint connector is loosely attached to the supporting member.

The Applicant has previously developed a casket lock of the catch-type described in co-pending application Ser. No. 09/175,085. More precisely, the lock comprises an engaging member comprising a locking pin, a receiving member and a biasing means. The receiving member comprises a female element, which is in the form of a sleeve and has a central axis. The female element comprises an opening lying in a plane parallel to the central axis and on the periphery of the sleeve to receive a portion of the locking pin. The female element further comprises an elongated slot on a portion thereof, lying in a plane perpendicular to the central axis. The elongated opening is defined by an upper and a lower end, each end having a recess extending to a given direction.

The male element has an inner and an outer end. The inner end is formed as a hollow cylinder case, which is adapted to be inserted within the female element and rotate with respect to the latter about an axis parallel to the central axis. The hollow cylinder also comprises a pear-shaped opening having a wider and a thinner portion to receive the portion of the locking pin. The male element further comprises a spring pin having a plane perpendicular to the central axis. The spring pin is adapted to engage in the elongated opening on the sleeve. The outer end of the element includes a keyway.

The receiving member further comprises a biasing means for outwardly biasing the male element with respect to the female element.

The lock, according to that embodiment, has an open and a closed position so that in the open position, the wider portion of the pear-shaped opening of the male element is in registration with the opening of the female element, and the spring pin is set into the recess of the upper end of the elongated opening of the female element. In order to bring the lock from an open position into a closed position, the male element is pushed inwardly through the keyway so to release the spring pin out of the recess into the elongated slot. The keyway is then rotated at a predetermined position so that the locking pin is engaged in the thinner portion of the pear-shaped opening of the male element, and the spring pin is engaged in the recess of the lower end.

Although the lock as defined above is easier to use and to install on a casket than the existing locks, its structure renders it more costly to produce, since it requires the production of several independent pieces, and thus, in the same way, renders its assembly more complicated.

SUMMARY OF THE INVENTION

The lock, according to the present invention, is designed to overcome the above problem. Thence, the present invention is concerned with a lock of the catch-type comprising an engaging member and a receiving member.

The engaging member comprises a locking pin.

The receiving member has an inner and an outer end, and comprises a female and a male element. The female element is in the form of a sleeve having an inner and an outer end. The sleeve has a central axis and comprises an opening lying in the plane parallel to said central axis and on a periphery of the female element. The sleeve also comprises an elongated slot on a portion thereof. The elongated opening is located in the inner end and lies in a plane perpendicular to the central axis. The female element further comprises a longitudinal notch extending from the outer end to a side of the elongated opening.

The male element also comprises an inner and an outer end. The inner end is formed of a hollow cylinder adapted to be inserted within the female element. The male element is adapted to rotate with respect to the female element about an axis parallel to the central axis. The hollow cylinder is provided with a pear-shaped opening having a wider and a thinner portion. The pear-shaped opening lies in a plane normal to the central axis for receiving the locking pin. The hollow cylinder case comprises a blocking element on its periphery for maintaining the male element tightly secured within the female element. The outer end of the male element includes a keyway.

Hence, the lock, according to the present invention, has an open position and a closed position. When the lock is in the open position, the wider portion of the pear-shaped opening of the male element and the opening of the female element are in registration for receiving a portion of the locking pin, and the blocking element is set into an upper end of the elongated opening. The lock is in a closed position when the locking pin is engaged within the male element. More precisely, the lock is brought from the open position to the close position when the keyway is rotated at a predetermined position, so that the locking pin is engaged with the thinner portion of the pear-shaped opening of the female element, and the blocking element is brought to a lower end of the elongated slot.

As can be noted, the lock, according to the present invention, has a structure allowing easy assembly of the lock, since the blocking element forms an integral part of the male element. Also, by nature of its structure, the lock is less inclined to break.

It is also an object of the invention to provide a lock that allows proper alignment of the locking pin in the corresponding receiving member of the lock.

Finally, it is also an object of the present invention to provide a casket comprising at least one lock according to the present invention so to provide locking means that appears discreet on the casket.

BRIEF DESCRIPTION OF THE INVENTION

Figure 1:
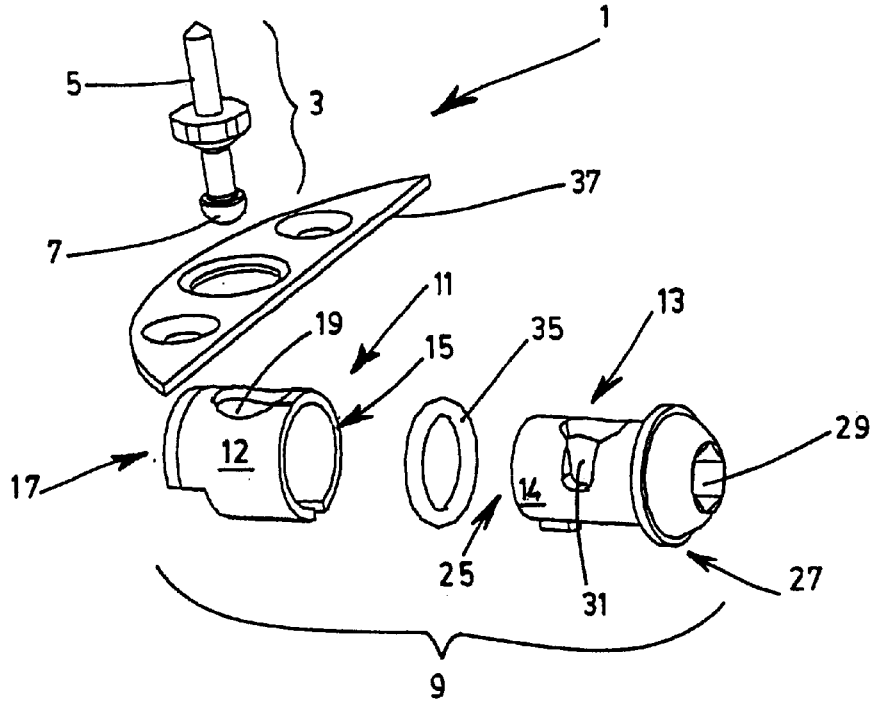
FIG. 1 is an exploded view of a lock according to a preferred embodiment of the invention.

As can be seen in FIG. 1, the lock (1) according to a preferred embodiment of the present invention comprises an engaging member (3) and a receiving member (9). The engaging member (3) comprises a locking pin (5).

The locking pin (5) has two extremities, one of which is provided with an attaching means for fixing the locking pin (5) in place. The other extremity is provided with an enlarged portion such as a knob (7) adapted to engage in the opening of the corresponding receiving member (9) of the lock (1). As can be seen, the locking pin (5) is preferably a ball-head screw.

The receiving member (9) generally comprises two components which are imbricated in such a way to allow them to rotate relative to each other from an open position to a closed position.

More precisely, the two components may be defined as a female element (11) and a male element (13). The female element (11) comprises a sleeve (12) having a central axis delimited by a first and a second end. The female element (11) also comprises an opening (19) sized and shaped to receive a portion of the locking pin (5). The female element (11) further comprises an engaging portion. The sleeve (12) may comprise on its periphery, a plurality of projections (16) for keeping the receiving member tightly secured in place in the wall of the casket during operation of same. The projections have a plane parallel to the central axis. Preferably, the sleeve (12) comprises four projections.

Figure 2:
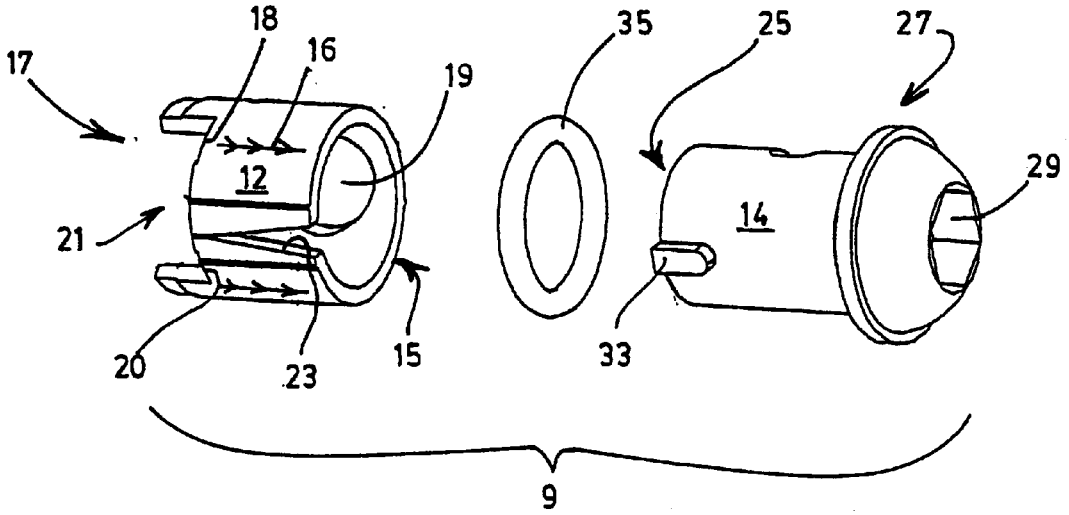
FIG. 2 is an exploded view of the engaging member of the lock of FIG. 1.
Figure 3:
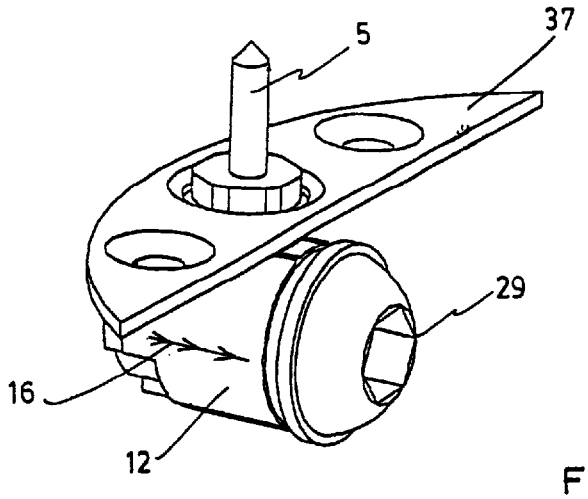
FIG. 3 is a front view of the lock of FIG. 1 assembled.
Figure 4:
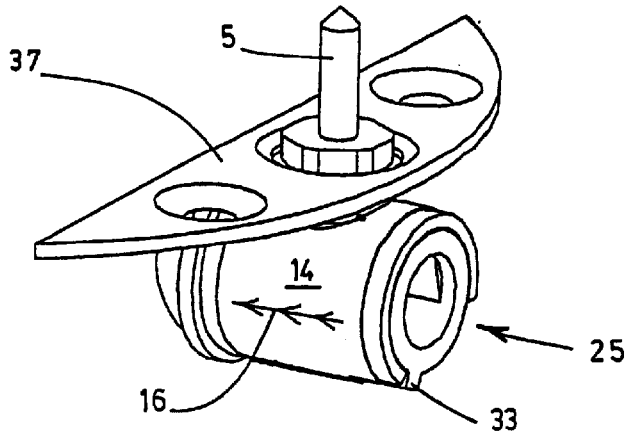
FIG. 4 is a back view of the lock of FIG. 3 in the open position.

As can be seen in FIG. 2, in a particular embodiment, the engaging portion comprises an elongated opening (21) and a longitudinal notch (23). The elongated opening (21) comprises an upper and a lower end and may be located proximate an inner end (17) of the female element (11). The elongated opening (21) has an axis perpendicular to the central axis and is in perpendicular relation with the longitudinal notch. The elongated opening (21) may further comprise a recess at each end. The recess extends in the direction of the outer end of the female element (11). The longitudinal notch (23) extends from the outer end of the female element to a side of the elongated opening (21). The notch (23) and elongated opening (21) are adapted to receive a blocking element, which may be a stop block (33) located on the male element (13).

The male element (13) comprises a cylinder case (14) having an inner and an outer end (25, 27). The cylinder case (14) is adapted to slidably be inserted in the female element (11) so that the male element (13) may rotate with respect to the female element (11) about an axis parallel to the central axis. The male element (13) further comprises a pear-shaped opening (31). The pear-shaped opening (31) is generally defined by a wider portion and a thinner portion. The thinner portion of the pear-shaped opening may be defined by a somewhat rounded or squared contour. The wider portion is sized to receive a corresponding end portion (7) of the locking pin (5). The thinner portion is sized to secure the end portion (7) of the locking pin (5) so that it remains engaged within the male and female elements (11, 13).

As mentioned above, in a particular embodiment, the male element (13) comprises a stop block (33) on the periphery of the cylinder case (14). The stop block (33) is positioned so that when the male element (13) is inserted in the female element (11), the stop block (33) engages in the notch (23) to reach the elongated opening (21).

The outer end (27) of the male element (13) may include a keyway, which can be adapted to be used in combination with an Allen key.

As can also be seen in FIG. 1, the lock (1) may further comprise a biasing means. The biasing means may consist of a ring (35). The ring (35) is made of a resistant and compressible material, such as polyurethane, polypropylene and buna "N". The ring (35) is installed in such a position so that during locking and unlocking of the lock (1). The biasing means may form an integral portion of the sleeve (12) of the female element (11), or be of a different form such as a spring.

For fastening the lock (1), an Allen key is inserted within the keyway (29) of the male element (13). Fastening of the lock (1) occurs when, once the male element (13) is biased against the female element (11), it is rotated at a predetermined position preferably about 90° in respect to the female element (11). As a result, the male element (13) rotates in respect to the female element (11) until the thinner portion of the pear-shaped opening (31) of the male element (13) is in registration with the opening (19) of the female element (11). Indeed, the locking pin (5) remains engaged within the receiving member (9) when the knob (7) of the locking pin (5) is trapped within the thinner portion of the pear-shaped opening (31) of the male element (13).

Hence, during locking, the ring will outwardly bias the male element (13) so to move the stop block (33) in the recess (18) of the upper end when the male element is rotated at the closed position.

To bring the lock from the closed position to the open position, the male element is inwardly biased against the female element so as to disengage the stop block (33) from the recess (18) of the upper end. Then, the male element is rotated at a predetermined position, preferably about 90° with respect to the female element so to drive the stop block (33) in the recess (18) of the lower end of the elongated opening (21).

Figure 5:
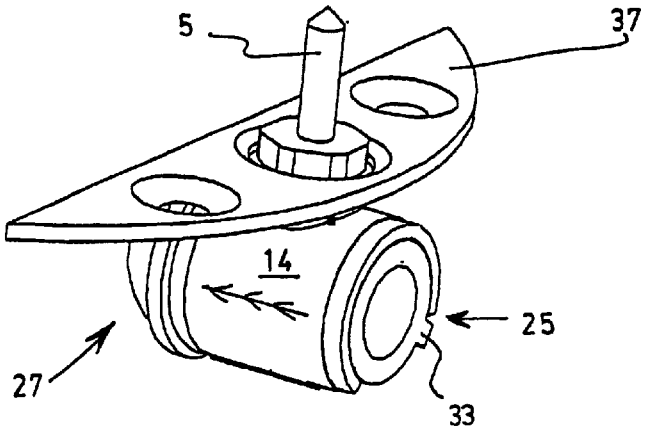
FIG. 5 is the back view of the lock of FIG. 4 in the closed position.

In the open position, as shown in FIG. 5, the opening (19) of the female element (11) is in registration with the wider portion of the pear-shaped opening (31) of the male element (13).

Figure 6:
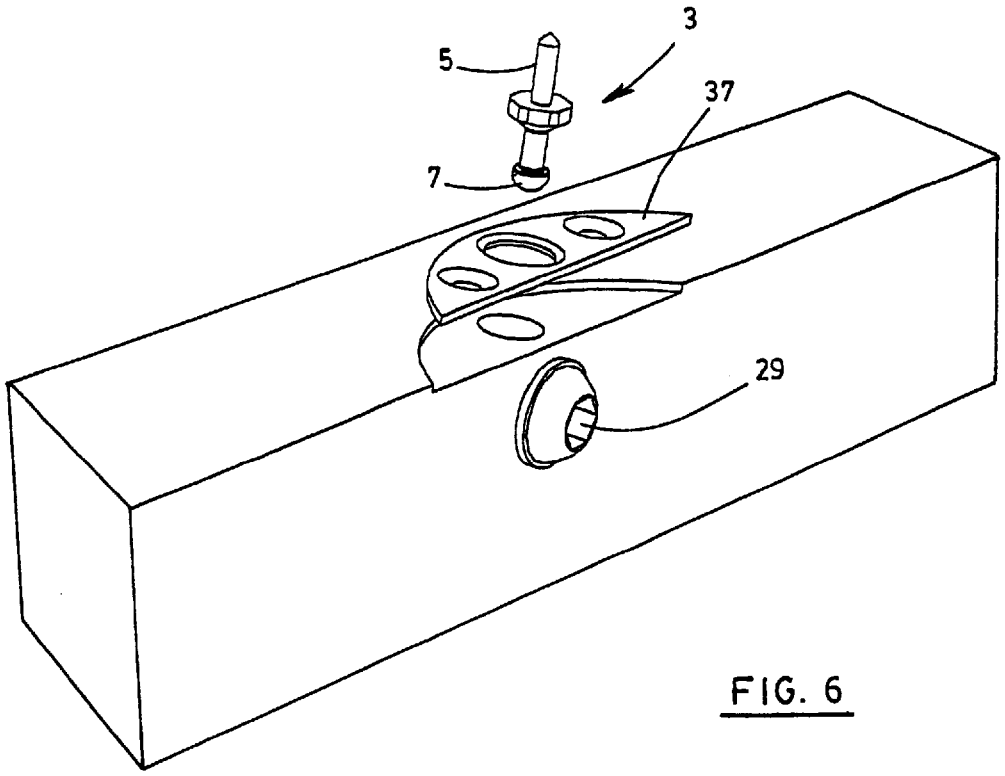
FIG. 6 is a perspective view of the lock of FIG. 1 partially installed on a portion of a wall.
Figure 7:
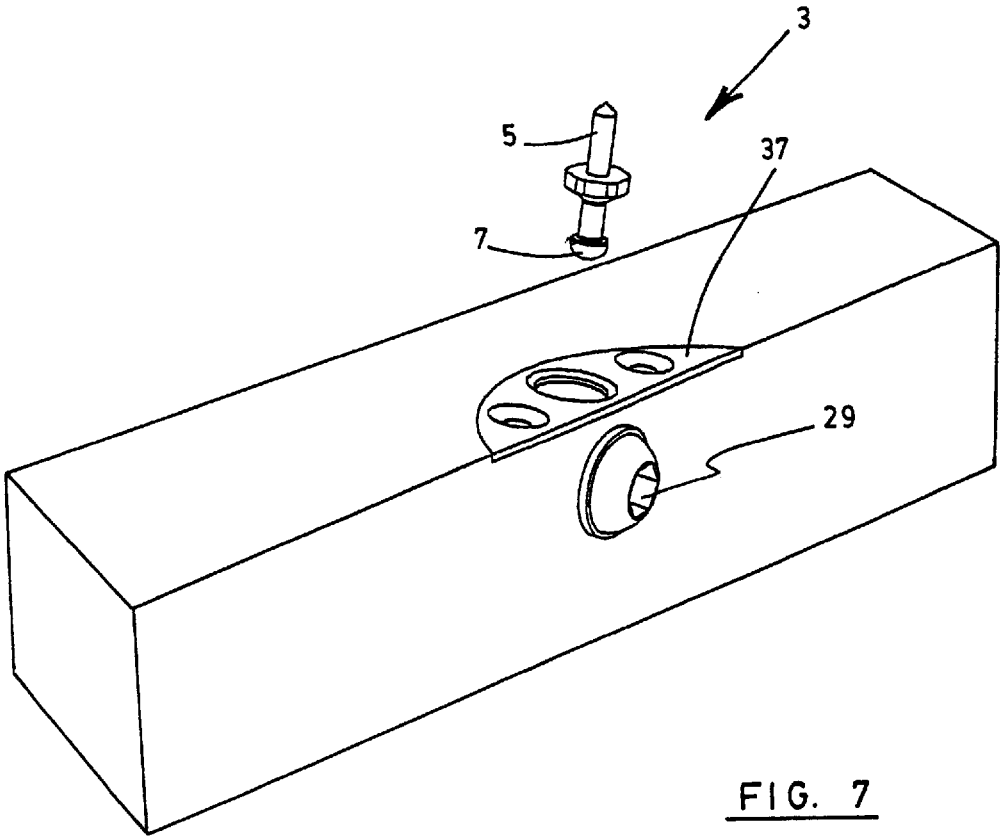
FIG. 7 is a perspective view of the lock of FIG. 6 installed on the portion of the wall.

Referring to FIGS. 6 and 7, in a preferred embodiment, the lock may further comprise a guide, which can be installed on top of the opening (19) on the female element (11). An object of the guide is to realign or facilitate the alignment of the knob (7) of the locking pin (5) inside the opening (19) of the receiving member of the lock (1) and to protect the hole on the wall (39) of the casket in cases where the lid is misaligned with the casket. The guide may be a plate (37) having the shape of a half-moon and comprising an opening for receiving the locking pin (5).

Hence, in order to interact with the receiving member (9) of the lock (1), the locking pin (5) is installed at a precise position opposite to it. More particularly, for use in combination with a casket, the locking pin (5) may be installed on the lid of same. The receiving member (9) is installed on one of the wall so that it is in registration with the locking pin (5). In other words, the receiving member (9) is installed so that the opening of the female and male elements (11, 13) are directly opposite to the locking pin (5) and the keyway (29) is facing the outer face of the wall.

The lock (1) of the present invention may be used in combination with a casket for locking the lid of same. It is worth mentioning that a casket may contain more than one lock. Such is the case of caskets having a lid composed of two halves wherein each half can operate independently.

As can also be appreciated, the lock, according to the present invention, can be used in combination with a compartment on the casket, such as fall-front type drawers.

What is claimed is:

1. A lock comprising:

an engaging member comprising a locking pin;

a receiving member having an inner and an outer end, the receiving member comprising:

a female element in the form of a sleeve having an inner and an outer end, said sleeve having a central axis and comprising an opening lying in a plane parallel to said central axis and on a periphery of said female element, said sleeve also comprising an elongated opening on a portion thereof, said elongated opening being located in the inner end and lying in a plane perpendicular to said central axis, said female element further comprising a longitudinal notch extending from the outer end of said female element to a side of said elongated opening;

a male element having an inner end and an outer end, said inner end being formed as a hollow cylinder adapted to be inserted within said female element, said male element adapted to rotate with respect to said female element about an axis parallel to said central axis, said hollow cylinder being provided with a pear-shaped opening having a wider and a thinner portion, said pear-shaped opening lying in a plane normal to said central axis for receiving said locking pin, said hollow cylinder case comprising a blocking element on its periphery for maintaining the male element tightly secured within the female element; said outer end of male element including a keyway; and biasing means for outwardly biasing said male element with respect to said female element, said lock having an open position and a closed position, said lock being in said open position when the wider portion of said pear-shaped opening of said male element and said opening of said female element are in registration for receiving a portion of said locking pin and said blocking element is set into an upper end of said elongated opening, said lock being in said closed position when said locking pin is engaged within said male element, said lock is brought from the open position to the closed position when said keyway is rotated at a predetermined position so that said locking pin is engaged with the thinner portion of said pear-shaped opening of said female element and said blocking element is brought to a lower end of said elongated slot.

2. A lock according to claim 1, wherein the biasing means consist of a compressible ring.

3. A lock according to claim 2, wherein the ring is made of buna "N".

4. A lock according to claim 3, wherein the locking pin comprises a first and a second end separated by an elongated portion, the first end comprising an attaching means, said second end comprising an enlarged portion in the form of a knob.

5. A lock according to claim 4, wherein the locking pin is a ball head screw.

6. A lock comprising:

an engaging member comprising a locking pin;

a receiving member having an inner and an outer end, the receiving member comprising:

a female element in the form of a sleeve having an inner and an outer end, said sleeve having a central axis and comprising an opening lying in a plane parallel to said central axis and on a periphery of said female element, said sleeve also comprising an elongated opening on a portion thereof, said elongated opening being located in the inner end and lying in a plane perpendicular to said central axis, said female element further comprising a longitudinal notch extending from the outer end of said female element to a side of said elongated opening;

a male element having an inner end and an outer end, said inner end being formed as a hollow cylinder adapted to be inserted within said female element, said male element adapted to rotate with respect to said female element about an axis parallel to said central axis, said hollow cylinder being provided with a pear-shaped opening having a wider and a thinner portion, said pear-shaped opening lying in a plane normal to said central axis for receiving said locking pin, said hollow cylinder comprising a blocking element on its periphery for maintaining the male element tightly secured within the female element; said outer end of the male element including a keyway; and a guide consisting of a plate installed in registration with the opening located on the female element, so to facilitate entrance of the locking pin into the receiving member of the lock, wherein the elongated opening of the female element comprises a recess at a lower end and at an upper end so that for opening the lock, the blocking element is driven out of the recess of the upper end of the elongated opening by pushing the male element inwardly against the female element and rotating same at about 90° so to drive the blocking element in the recess at the lower end of the elongated opening, said lock having an open position and a closed position, said lock being in said open position when the wider portion of said pear-shaped opening of said male element and said opening of said female element are in registration for receiving a portion of said locking pin and said blocking element is set into an upper end of said elongated opening, said lock being in said closed position when said locking pin is engaged within said male element, said lock is brought from the open position to the closed position when said keyway is rotated at a predetermined position so that said locking pin is engaged with the thinner portion of said pear-shaped opening of said female element and said blocking element is brought to a lower end of said elongated slot.

7. A lock according to claim 6, wherein the keyway is configured so as to be used in combination with an Allen key.

8. A lock according to claim 7, wherein the sleeve comprises at least one projection on the periphery for maintaining in place the receiving member, said projection lying in a plane parallel to said central axis.

9. A lock according to claim 6 further comprising a biasing means for outwardly biasing said male element with respect to said female element.

10. In combination, a casket having four-side walls, a lid adapted to pivot between an open and a closed position, and at least a lock the lock comprising:

an engaging member comprising a locking pin, the locking pin being installed on the lid;

a receiving member having an inner and an outer end, the receiving member being installed in registration with the locking pin on one of said corresponding wall, the receiving member comprising:

a female element in the form of a sleeve having an inner and an outer end, said sleeve having a central axis and comprising an opening lying in a plane parallel to said central axis and on a periphery of said female element, said sleeve also comprising an elongated opening on a portion thereof, said elongated opening being located in the inner end and lying in a plane perpendicular to said central axis, said female element further comprising a longitudinal notch extending from the outer end of said female element to a side of said elongated opening;

a male element having an inner end and an outer end, said inner end being formed as a hollow cylinder adapted to be inserted within said female element, said male element adapted to rotate with respect to said female element about an axis parallel to said central axis, said hollow cylinder being provided with a pear-shaped opening having a wider and a thinner portion, said pear-shaped opening lying in a plane normal to said central axis for receiving said locking pin, said hollow cylinder case comprising a blocking element on its periphery for maintaining the male element tightly secured within the female element; said outer end of male element including a keyway;

said lock having an open position and a closed position, said lock being in said open position when the wider portion of said pear-shaped opening of said male element and said opening of said female element are in registration for receiving a portion of said locking pin and said blocking element is set into an upper end of said elongated opening, said lock being in said closed position when said locking pin is engaged within said male element, said lock is brought from the open position to the closed position when said keyway is rotated at a predetermined position so that said locking pin is engaged with the thinner portion of said pear-shaped opening of said female element and said blocking element is brought to a lower end of said elongated opening.

11. A lock according to claim 10, wherein the sleeve comprises at least one projection on the periphery for maintaining in place the receiving member in said wall of said casket, said projection lying in a plane parallel to said central axis.

12. A lock according to claim 11, wherein the locking pin comprises a first and a second end, said first end comprising an attaching means, said second end comprising an enlarged portion in the form of a knob.

13. A lock according to claim 12, wherein the locking pin is a ball-head screw.

14. A lock according to claim 13, wherein said lock further comprises a biasing means for outwardly biasing said male element with respect to said female element.

15. A lock according to claim 14, wherein the biasing means consist of a compressible ring.

16. A lock according to claim 15, wherein the ring is made of buna "N".

17. A lock according to claim 16, wherein the elongated opening comprises a recess at a lower end and at an upper end so that for opening the lock the blocking element is driven out of the recess of the upper end of the elongated opening by pushing the male element inwardly against the female element and rotating same at about 90° so to drive the blocking element in the recess at the lower end of the elongated opening.

18. A lock according to claim 17, further comprising a guide consisting of a plate in the form of a half-moon installed in registration with the opening located on the female element, so as to facilitate entrance of the locking pin into the receiving member of the lock.

19. A lock according to claim 18, wherein the keyway is configured so as to be used in combination with an Allen key.

* * * * *

UNITED STATES PATENT AND TRADEMARK OFFICE

CERTIFICATE OF CORRECTION

PATENT NO. : 6,152,499
DATED : November 28, 2000
INVENTOR(S) : Pascal Robert

It is certified that error appears in the above-identified patent and that said Letters Patent is hereby corrected as shown below:

[75) Assignee: Cercueils Vic Royal Inc., (not Cercuiels Vice Royal Inc.)

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*